US007814705B2

(12) United States Patent
Reed

(10) Patent No.: US 7,814,705 B2
(45) Date of Patent: Oct. 19, 2010

(54) AUTOMATIC STORM SHUTTER

(76) Inventor: Robert S. Reed, 1204 Sunland Rd., Daytona Beach, FL (US) 32114

( * ) Notice: Subject to any disclaimer, the term of this patent is extended or adjusted under 35 U.S.C. 154(b) by 0 days.

(21) Appl. No.: 12/317,326

(22) Filed: Dec. 23, 2008

(65) Prior Publication Data

US 2010/0154317 A1 Jun. 24, 2010

(51) Int. Cl.
*E05F 15/20* (2006.01)

(52) U.S. Cl. ..... 49/31; 49/394

(58) Field of Classification Search ..... 49/394, 49/1, 31, 24, 63, 67; 292/137, 146, 150, 292/144, DIG. 36; 16/48.5
See application file for complete search history.

(56) References Cited

U.S. PATENT DOCUMENTS

| | | | | | |
|---|---|---|---|---|---|
| 1,169,596 | A | * | 1/1916 | Avery | 49/1 |
| 1,938,978 | A | * | 12/1933 | Hunter et al. | 16/197 |
| 2,142,690 | A | * | 1/1939 | Goserud | 49/356 |
| 2,732,920 | A | * | 1/1956 | Newton | 16/48.5 |
| 3,029,422 | A | * | 4/1962 | Wilson | 340/601 |
| 3,345,775 | A | * | 10/1967 | Crosby | 49/4 |
| 3,952,452 | A | | 4/1976 | Hebda | |
| 4,237,578 | A | * | 12/1980 | Welch | 16/48.5 |
| 4,483,043 | A | * | 11/1984 | Tillmann | 16/56 |
| 4,706,330 | A | * | 11/1987 | Sampson | 16/48.5 |
| 4,750,303 | A | | 6/1988 | Mullen | |
| 5,515,649 | A | | 5/1996 | Strab | |
| 5,592,780 | A | * | 1/1997 | Checkovich | 49/386 |
| 6,121,869 | A | | 9/2000 | Burgess | |
| 6,329,617 | B1 | | 12/2001 | Burgess | |
| 6,425,211 | B1 | * | 7/2002 | Wise et al. | 52/1 |
| 6,484,459 | B1 | | 11/2002 | Platts | |
| 7,001,468 | B1 | | 2/2006 | Sheydayi | |
| 7,342,375 | B2 | | 3/2008 | Johansen | |
| 2003/0226235 | A1 | | 12/2003 | Hodson | |
| 2005/0005523 | A1 | * | 1/2005 | Johnston | 49/74.1 |
| 2005/0212304 | A1 | * | 9/2005 | Herrera et al. | 292/251.5 |
| 2006/0012191 | A1 | * | 1/2006 | Brei et al. | 292/341.17 |
| 2007/0107458 | A1 | | 5/2007 | Kim | |
| 2008/0092630 | A1 | | 4/2008 | Piorkowski | |
| 2008/0146143 | A1 | | 6/2008 | Chilelli et al. | |

* cited by examiner

*Primary Examiner*—Katherine W Mitchell
*Assistant Examiner*—Catherine A Kelly
(74) *Attorney, Agent, or Firm*—Paul S. Rooy PA

(57) ABSTRACT

An automatic storm shutter. A shutter is hingeadly attached to a wall over a structure opening. An actuator is attached to the shutter, and releasably engaged with a support, which is rigidly attached to the wall. When external atmospheric pressure descends, as would happen at the approach of a wind storm such as a tornado, gas pressure within the actuator automatically releases the actuator from the support, which permits the shutter to quickly close as urged by gravity, to cover the structure opening and protect it from storm winds. An alternate embodiment is disclosed wherein one or more additional shutters are installed below the automatic storm shutter. The shutters are mutually attached with an elongate member. When the automatic storm shutter automatically closes, so also do the shutters below.

20 Claims, 5 Drawing Sheets

AUTOMATIC STORM SHUTTER

BACKGROUND OF THE INVENTION

1. Field of the Invention

This invention relates to storm shutters, and in particular to an automatic storm shutter.

2. Background of the Invention

In the brief interval before a tornado is sighted and it's actual strike, it is unrealistic to expect occupants of structures to close their windows, shutters, etc. All the occupants can be expected to do is to protect themselves as best they can.

In trying to design a building that is capable of surviving tornado-strength winds, it is crucial that the windows, as required by practicality and building codes, be able to protect themselves automatically and instantaneously from high winds, flying debris, and yet be able to provide ventilation when required.

Accordingly, it would be desirable to provide an automatic storm shutter capable of sensing the abrupt decrease in pressure which occurs immediately before a tornado strikes, and to quickly respond by automatically closing the shutter to protect the structure aperture it then covers.

It is extremely important that the automatic storm shutter react very quickly and automatically. By the time high, tornado-force winds arrive, it is too late. These winds can ascend to 300 miles per hour. The severe and sudden pressure drop which occurs immediately before a tornado strikes is virtually the only solid indication of the imminent arrival of a tornado, with potentially disastrous results. This drop in pressure could occur in as little as one to three seconds prior to the tornado striking, so fast reaction and closing on the part of the automatic storm shutter is crucial.

In addition, it would be desirable to provide an automatic storm shutter which affords shade from the sun to the structure opening it protects. This ability can greatly improve the air conditioning efficiency, and reduced the summer cooling load in the structure, when a storm is not present.

Existing Designs

A number of approaches have been attempted to deal with this problem. U.S. Pat. No. 7,342,375 was granted Johansen for an automatic storm shutter control which used an electric motor to close roll-down shutters when commanded by a rain sensor. While this design closed shutters when rain was detected, it's operation was too slow to respond to a tornado, which could require fast, one-second reaction time to close the shutter.

Another problem could be the power supply for the electric motor. If a power failure has occurred, such as happens frequently in the vicinity of tornados, hurricanes, and other wind storms, this design would not operate. If other stored power sources of actuation were used, such as compressed air or stored electricity, the complexity, number of failure modes, and cost of the design would increase.

In addition, no provision was taught to close the shutter as a response to high, tornado-strength winds—only rain. It is possible to be hit by a tornado without rain, so this design would not command the storm shutters to close in this scenario, depriving the structure openings of protection.

U.S. Pat. No. 3,952,452 was granted Hebda for a device which assisted the closing of a door. This invention was intended to be used to assist the opening of a stairwell exit door where a fire-suppressant blower has been actuated to pressurize the air in the stairwell, to prevent fire from spreading floor-to-floor. This pressurization tends to make opening inward-opening doors difficult or even impossible. While this reference taught an apparatus to aid in the opening of such doors using weights and pulleys, no provision was disclosed to rendered the function automatic in the presence of a tornado-induced pressure drop. In addition, this reference taught an aid to open doors, not to close shutters to protect structure apertures.

U.S. Pat. No. 4,750,303 was granted Mullen for a silo door which would open automatically in the presence of internal silo pressure, such as might be generated by a silo explosion. While this reference taught an automatically opening door, it did not disclose an apparatus to automatically and quickly close shutters to protect structure apertures against imminent tornados.

SUMMARY OF THE INVENTION

Accordingly, it is an object of the present invention to provide an automatic storm shutter which quickly and automatically closes in the presence of a pressure drop heralding the approach of a tornado. Design features allowing this object to be accomplished include an actuator attached to a downwards-closing storm shutter, and a support to which the actuator is releasably engaged. Advantages associated with the accomplishment of this object include protection of life and property within a structure protected by the automatic storm shutter.

It is another object of the present invention to provide an automatic storm shutter which does not require electricity or external power, other than gravity, to operate. Design features allowing this object to be accomplished include an actuator attached to a downwards-closing storm shutter, and a support to which the actuator is releasably engaged, so that release of the storm shutter quickly slams the shutter closed as urged by gravity. A benefit associated with the accomplishment of this object is greater reliability of operation, even where a power failure has occurred.

It is still another object of this invention to provide an automatic storm shutter which provides shade when open. Design features enabling the accomplishment of this object include a shutter hingeadly attached to a wall over a structure opening, so the structure aperture is shaded from impingement of direct sunshine. Advantages associated with the realization of this object include improvement of air conditioning efficiency, and reduction of summer cooling load in a structure.

It is another object of the present invention to provide an automatic storm shutter which can be ganged to other shutters. Design features allowing this object to be accomplished include an actuator attached to a downwards-closing storm shutter, a support to which the actuator is releasably engaged, and at least one other shutter disposed below the automatic storm shutter and attached to it by means of an elongate member. Benefits associated with the accomplishment of this object include greater flexibility of installation, and the ability to protect several vertically arrayed structure openings.

It is yet another object of this invention to provide an automatic storm shutter which is simple and inexpensive to construct and install. Design features allowing this object to be achieved include the use of components made of readily available materials. Benefits associated with reaching this objective include reduced cost, and hence increased availability.

BRIEF DESCRIPTION OF THE DRAWINGS

The invention, together with the other objects, features, aspects and advantages thereof will be more clearly understood from the following in conjunction with the accompanying drawings.

Five sheets of drawings are provided. Sheet one contains FIG. 1. Sheet two contains FIG. 2. Sheet three contains FIGS. 3-5. Sheet four contains FIG. 6. Sheet five contains FIG. 7.

DETAILED DESCRIPTION OF THE PREFERRED EMBODIMENT

Figure 1:
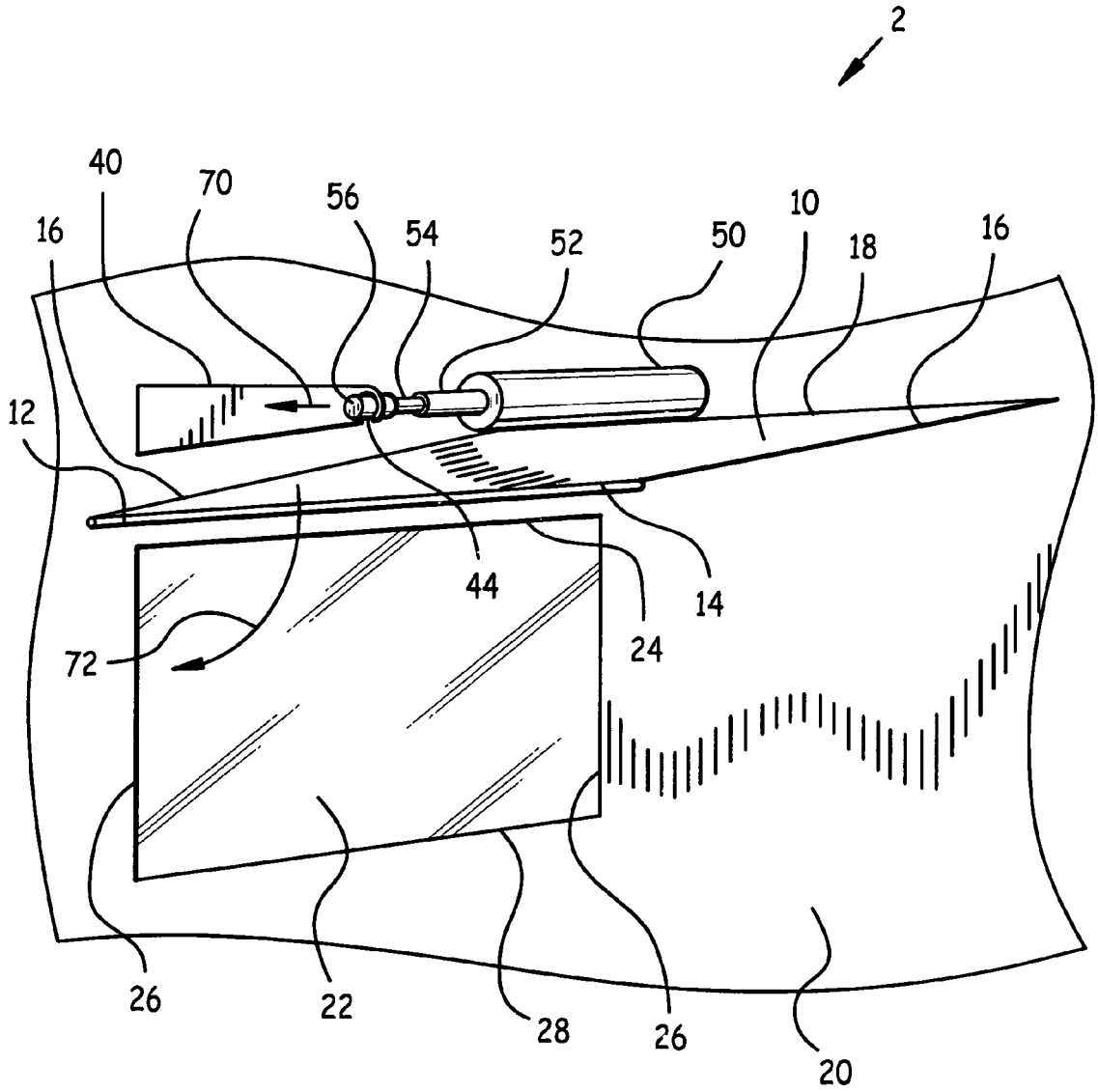
FIG. 1 is a front quarter view isometric view of an automatic storm shutter in the open position.

FIG. 1 is a front quarter isometric view of automatic storm shutter 2 in the open position. Automatic storm shutter 2 comprises shutter 10 hingeadly attached to wall 20 by hinge 12, support 40 rigidly attached to wall 20, and actuator 50 attached to shutter 10 and releasably engaged with support 40.

Actuator 50 responds to lowered atmospheric pressure by extending actuator shaft 52, as indicated by arrow 70 in FIG. 1. Extension of actuator shaft 52 disengages actuator 50 (and the shutter 10 to which it is attached) from support 40. Once released from support 40, gravity urges shutter 10 to swing downwards on hinge 12 into the closed position, as indicated by arrow 72 in FIG. 1 and in FIG. 2.

Figure 2:
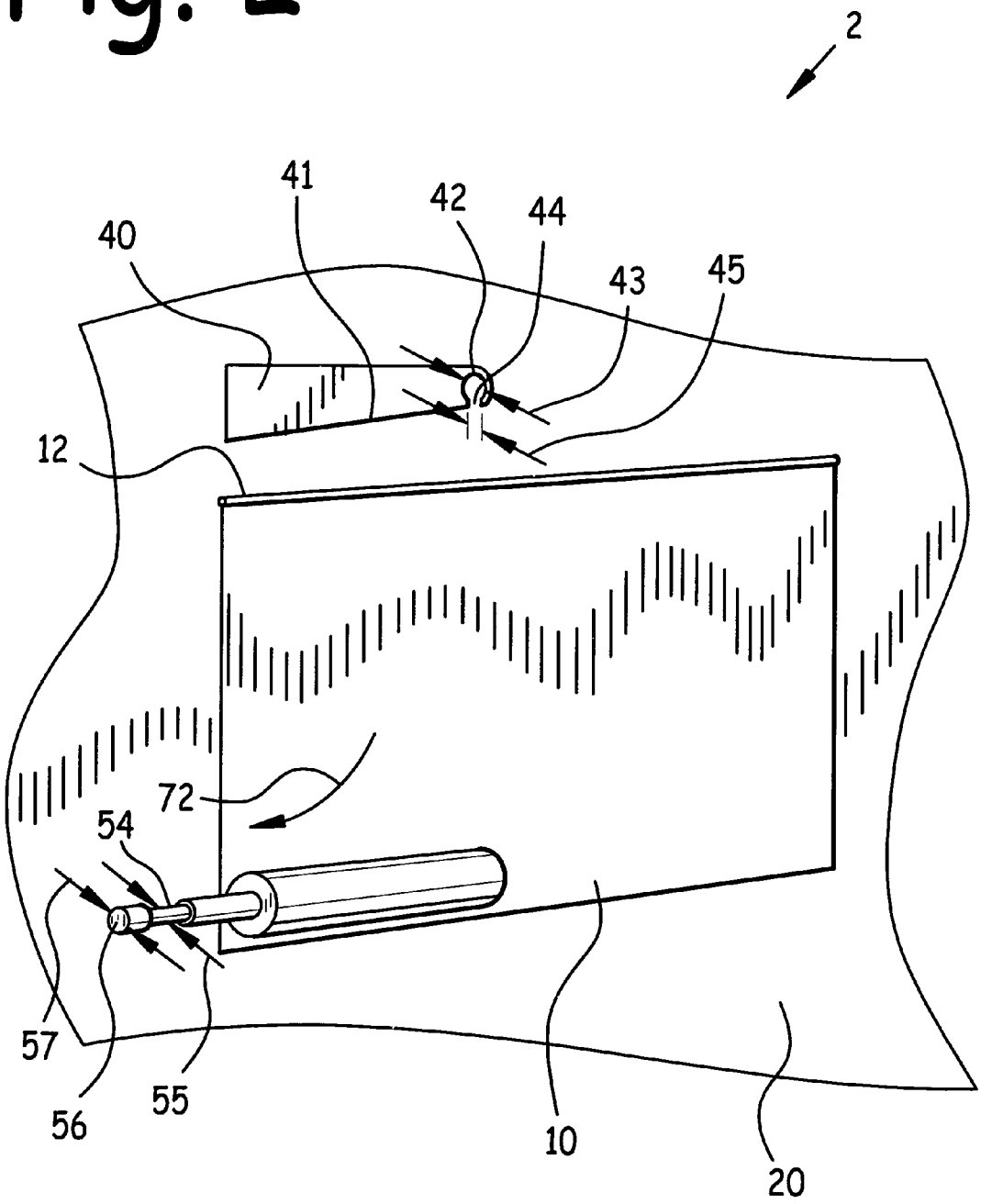
FIG. 2 is a front quarter isometric view of an automatic storm shutter in the closed position.
Figure 3:
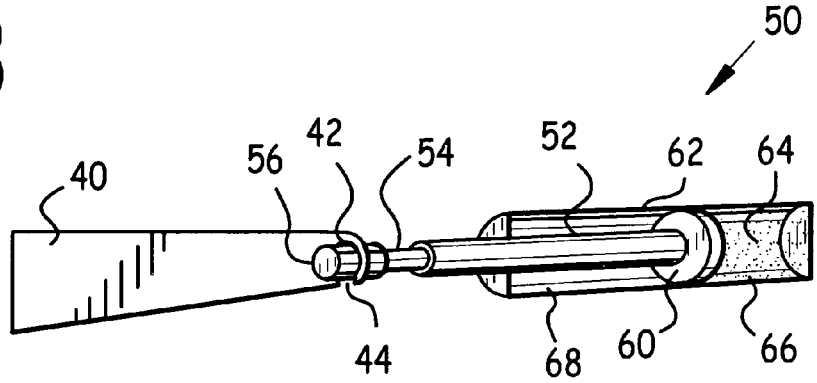
FIGS. 3-5 are front quarter isometric cutaway views of an actuator extending its actuator shaft and releasing it from a support, in response to a decrease in external pressure.
Figure 4:
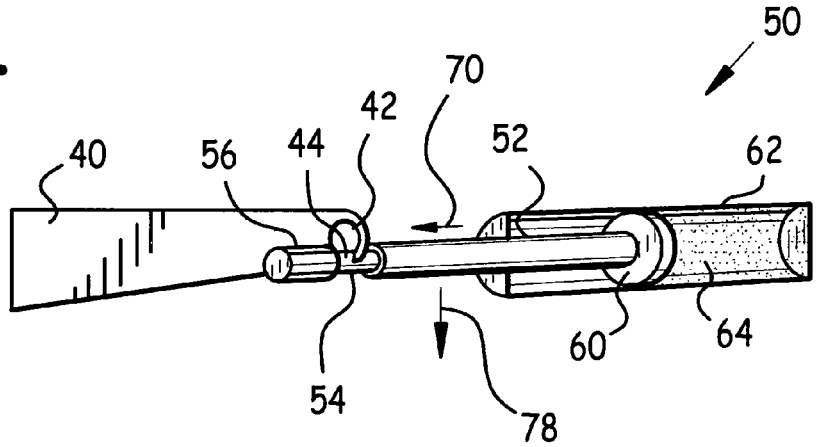
Figure 5:
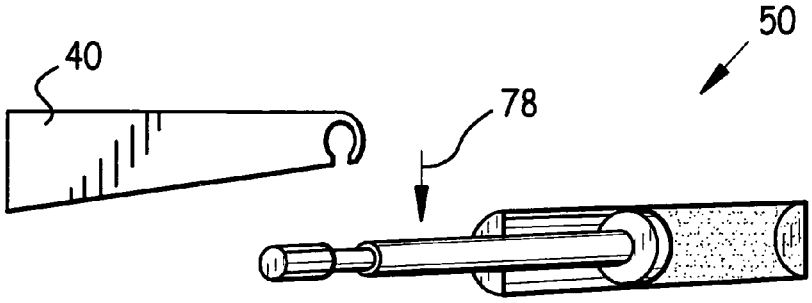

FIG. 2 is a front quarter isometric view of automatic storm shutter 2 in the closed position, covering and overlapping the structure opening 22 it is intended to protect. FIGS. 3-5 are front quarter isometric cutaway views of actuator 50 extending its actuator shaft 52 and releasing from support 40, in response to a decrease in external pressure.

Referring now to FIGS. 1-5, actuator 50 comprises piston 60 reciprocating within cylinder 62. Actuator shaft 52 is attached to piston 60, so that when piston 60 reciprocates, so also does actuator shaft 52, in the same direction and to the same extent.

Actuator shaft head 56 having actuator shaft head width 57 is disposed at the extreme of actuator shaft 52 opposite piston 60. Actuator shaft neck 54 having actuator shaft neck width 55 is disposed adjacent actuator shaft head 56, between actuator shaft head 56 and piston 60. Actuator shaft neck width 55 is less than actuator shaft head width 57.

Support 40 comprises support aperture 42 sized to slidably admit actuator shaft head 56. Support aperture 42 has support aperture width 43, which is greater than actuator shaft head width 57.

Support aperture cutout 44 having support aperture cutout width 45 extends downward from support aperture 42 to support lower edge 41. Support aperture cutout width 45 is greater than actuator shaft neck width 55. Therefore, support aperture cutout 44 is sized to slidably admit actuator shaft neck 54. Thus, when piston 60 drives actuator shaft 52 towards support 40 until actuator shaft neck 54 aligns with support aperture cutout 44, actuator shaft neck 54 is free to slide out of support aperture 42 as urged by gravity, through support aperture cutout 44, and out of engagement with support 40.

Because support aperture cutout 44 extends downwards from support aperture 42, gravity can effectively urge actuator shaft neck 54 to slide out of support aperture 42 and support aperture cutout 44, and thus disengage actuator 50 and shutter 10 from support 40.

Piston 60 separates the interior of cylinder 62 into cylinder gas side 66 on the side of piston 60 opposite actuator shaft 52, and cylinder open side 68 on the side of actuator shaft 52 side of piston 60. Cylinder gas side 66 is filled with gas 64 and is closed, thus entrapping gas 64 within cylinder 62 on the side of piston 60 opposite actuator shaft 52.

The pressure of gas 64 is substantially 14.7 pounds per square inch ("psi"). Cylinder open side 68 communicates with atmosphere, and so is at external atmospheric pressure. When the external atmospheric pressure drops below 14.7 psi, the pressure of gas 64 starts to urge piston 60 and actuator shaft 52 towards support 40.

When the external atmospheric pressure drops to substantially 12 psi (such as may occur when a tornado is imminent), the force which gas 64 exerts on piston 60 is sufficient to overcome the internal actuator 50 friction, and the friction between actuator shaft head 56 and support aperture 42, and piston 60 drives actuator shaft 52 towards support 40 as depicted by arrow 70 in FIG. 4.

When gas 64 drives actuator shaft head 56 completely out of support aperture 42, actuator shaft neck 54 is disposed within support aperture 42. Because actuator shaft neck width 55 is less than support aperture cutout width 45, actuator shaft neck 54 passes through support aperture cutout 44 under the urging of gravity, as indicated by arrow 78 in FIG. 4 and arrow 78 in FIG. 5.

After actuator shaft neck 54 passes through support aperture cutout 44, actuator 50 and the shutter 10 to which it is attached are no longer held open by support 40, and shutter 10 quickly slams shut as indicated by arrow 72 in FIG. 2. In this manner the instant automatic storm shutter 2 quickly closes in the presence of a rapid atmospheric pressure drop heralding the approach of a tornado, thus protecting a structure opening 22 such as a window or door.

Once shutter 10 is closed, gravity and wind pressure operate to keep shutter 10 closed over structure opening 22. In the preferred embodiment shutter 10 overlapped structure opening 22 on all four sides, so gravity and wind pressure kept shutter 10 firmly pressed against wall 20 over structure opening 22, thus protecting structure opening 22 from damaging wind storm forces.

After passage of the tornado or other windstorm which closed shutter 10, shutter 10 may be re-opened into the open position depicted in FIG. 1 simply by swinging shutter 10 upwards on hinge 12, opposite the sense of arrow 72 in FIG. 1, actuator shaft head 56 is pulled away from cylinder 62 until actuator shaft neck 65 aligns with support aperture cutaway 44, then actuator shaft neck 54 is pushed upwards through support aperture cutaway 44 into support aperture 42, and finally actuator shaft head 56 is allowed to retract into support aperture 42, thereby releasably engaging actuator 50 with support 40, and holding shutter 10 in the open position, ready for another automatic closing In the embodiment depicted in the instant figures, structure opening 22 was rectangular, with structure opening top edge 24 parallel to and adjacent hinge 12, structure opening bottom edge 28 opposite structure opening top edge 24, and structure opening side edges 26 extending from structure opening top edge 24 to structure opening bottom edge 28.

Similarly, shutter 10 was rectangular, with hinge 12 attached to shutter hinge edge 14, shutter distal edge 18 opposite shutter hinge edge 14, and shutter side edges 16 extending from shutter hinge edge 14 to shutter distal edge 18. In the embodiment depicted in the figures, shutter 10 overlaps structure opening 22 when shutter 10 is in the closed position depicted in FIGS. 2 and 7. In this embodiment, a length of shutter hinge edge 14 exceeds a length of structure opening top edge 24, a length of shutter distal edge 18 exceeds a length of structure opening bottom edge 28, and a length of shutter side edges 16 exceeds a length of structure opening side edges 26.

While the embodiment depicted in the instant figures depicts shutter 10 and structure opening 22 as rectangular, it is intended to fall within the scope of this disclosure that shutter 10 and structure opening 22 be any shape.

In the embodiment depicted in the instant figures, cylinder 62 had a round cross-section, and the cross-sectional shapes of actuator shaft 52, actuator shaft neck 54, actuator shaft head 56, and support aperture 42 were round. In this embodiment, actuator shaft neck width 55 equaled the diameter of actuator shaft neck 54, actuator shaft head width 57 equaled the diameter of actuator shaft head 56, and support aperture width 43 equaled the diameter of support aperture width 42.

While the instant figures depict an embodiment wherein cylinder 62 has a round cross-section; and the cross-sectional shapes of actuator shaft 52, actuator shaft neck 54, actuator shaft head 56, and support aperture 42 are round; it is intended to fall within the scope of this disclosure that the cross-sectional shape of cylinder 62, actuator shaft 52, actuator shaft neck 54, actuator shaft head 56, and support aperture 42 have any appropriate cross-sectional shape, including but not limited to round, square, rectangular, polygonal, and irregular shape.

Figure 6:
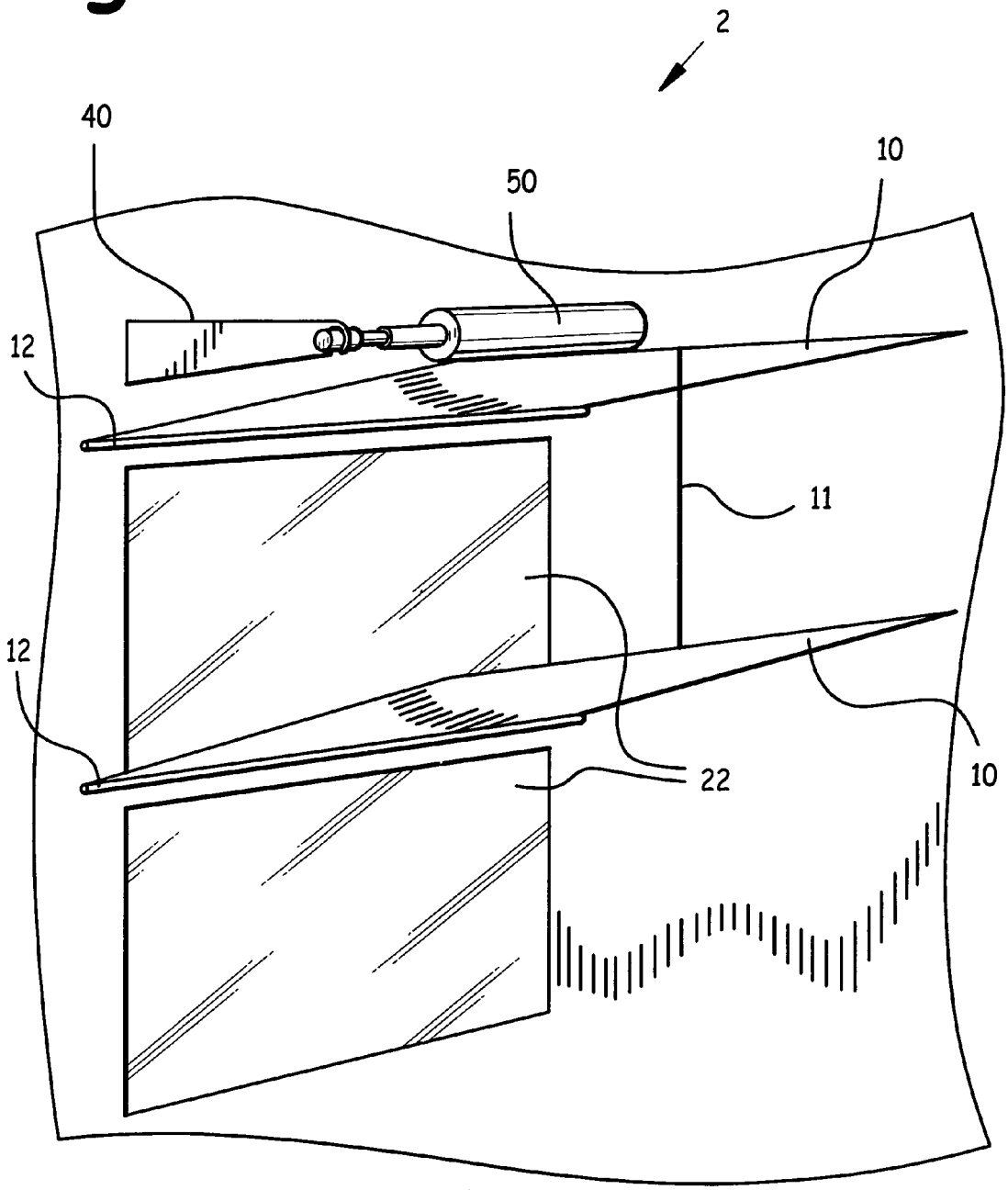
FIG. 6 is a front quarter isometric view of a lower shutter ganged to an upper automatic storm shutter, in the open position.
Figure 7:
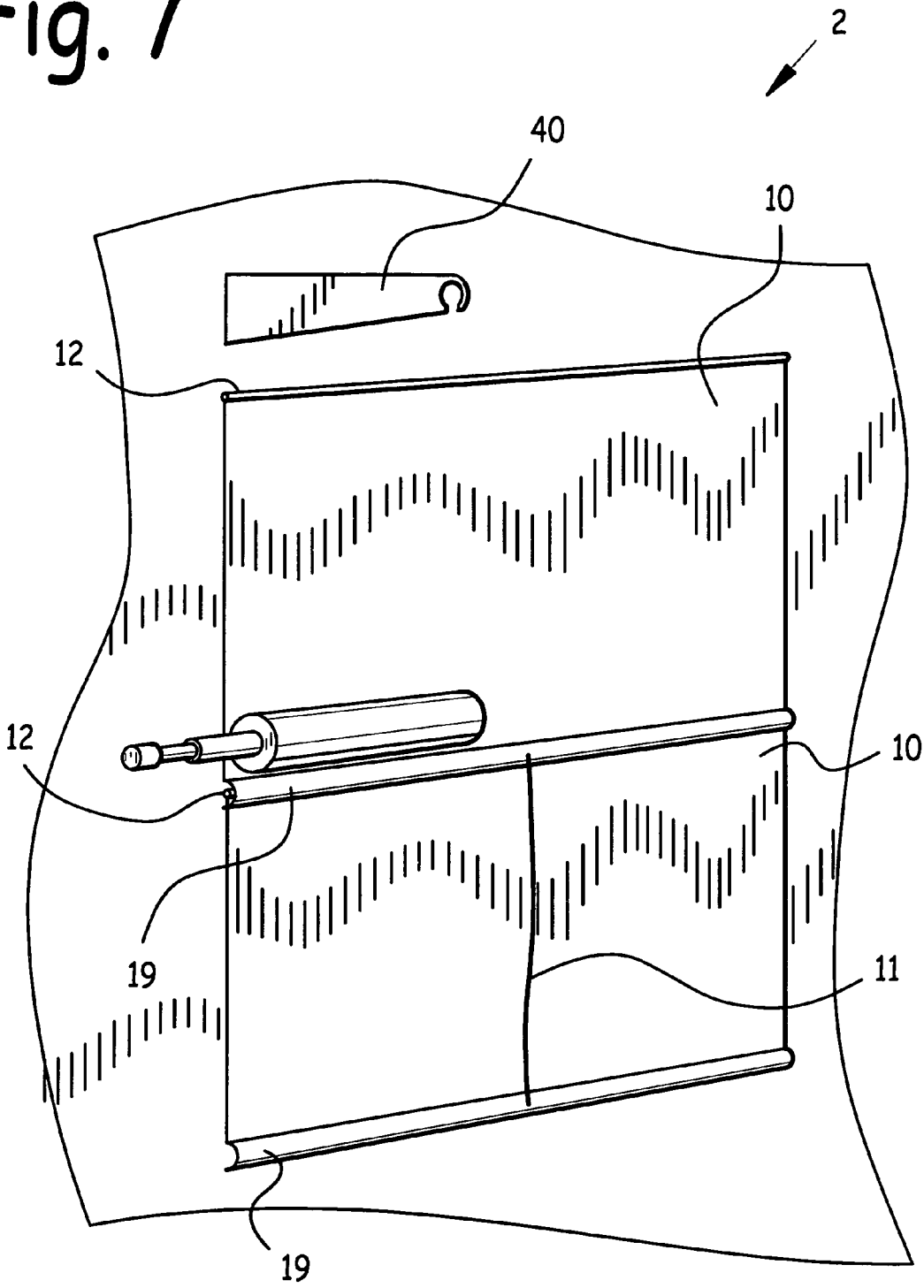
FIG. 7 is a front quarter isometric view of a lower shutter 10 ganged to an upper automatic storm shutter in the closed position.

FIG. 6 is a front quarter isometric view of a lower shutter 10 ganged to an upper automatic storm shutter 2, in the open position. FIG. 7 is a front quarter view isometric of a lower shutter 10 ganged to an upper automatic storm shutter 2 in the closed position. The installation depicted in FIGS. 6 and 7 is appropriate where two or more structure openings 22 exist in a vertical array.

In the embodiment depicted in FIGS. 6 and 7, the top shutter 10 is attached to the bottom shutter 10 by means of elongate member 11. Thus, when top shutter 10 is held open by actuator 50 releasably engaged in support 40, elongate member 11 holds bottom shutter 10 open also. When top shutter is released by actuator 50 disengaging from support 40, gravity quickly closes both top shutter 10 and bottom shutter 10, into the closed position indicated in FIG. 7. Elongate member 11 holds a plane containing top shutter 10 substantially parallel to a plane containing bottom shutter 10.

Although only one additional shutter 10 is depicted below the top shutter 10, it is intended to fall within the scope of this disclosure that multiple shutters 10 may be installed below the top shutter 10. Each shutter 10 is attached to the top shutter 10 by a common elongate member 11, by individual elongate members 11, or to one or more superior shutters 10 by one or more elongate members 11.

At least one shutter 10 may incorporate shutter distal edge lip 19 along its shutter distal edge 18. Shutter distal edge lip 19 is concave in cross-section, with an open end facing one hinge 12 from which one additional shutter 10 depends, and is sized to admit that hinge 12. In this way, shutter distal edge lip 19 permits vertically adjacent shutters 10 to overlap, increasing the protection against storm winds afforded by vertically arrayed shutters 10.

After passage of the windstorm which automatically closed shutters 10, both are re-opened as described above. The action of re-opening the top shutter 10 also re-opens the bottom shutter 10, because bottom shutter 10 is attached to top shutter 10 by means of elongate member 11.

As may be observed in FIGS. 1, 6 and 7, shutter(s) 10 provide shade to structure opening 22, which prevents direct sunlight from impinging on structure opening 22. This feature of the instant invention provides the advantages of improvement of air conditioning efficiency, and reduction of summer cooling load in a structure.

In the preferred embodiment, actuator 50 was a gas cylinder similar to those used to shock absorb closing screen doors, hinge 12 was a commercially available hinge, and shutter 10 and support 40 were steel, metal, synthetic, plastic, wood, or other appropriate material. Elongate member 11 was chain, rope, cable, or any other appropriate elongate member appropriate for mutually connecting vertically disposed shutters 10.

While a preferred embodiment of the invention has been illustrated herein, it is to be understood that changes and variations may be made by those skilled in the art without departing from the spirit of the appending claims.

Drawings Item Index

2 automatic storm shutter
10 shutter
11 elongate member
12 hinge
14 shutter hinge edge
16 shutter side edge
18 shutter distal edge
19 shutter distal edge lip
20 wall
22 structure opening
24 structure opening top edge
26 structure opening side edge
28 structure opening bottom edge
40 support
41 support lower edge
42 support aperture
43 support aperture width
44 support aperture cutout
45 support aperture cutout width
50 actuator
52 actuator shaft
54 actuator shaft neck
55 actuator shaft neck width
56 actuator shaft head
57 actuator shaft head width
60 piston
62 cylinder
64 gas
66 cylinder gas side
68 cylinder open side
70 arrow
72 arrow
74 arrow
76 arrow
78 arrow
80 arrow

I claim:

1. An automatic storm shutter system comprising an actuator, a support, a shutter, and means of releasably attaching said shutter to said support;

said shutter being hingeadly attached to a wall with a hinge above a structure opening;

said support being attached to said wall;

said actuator being attached to said shutter; whereby when said actuator causes said means of releasably attaching said shutter to said support to release said shutter from said support, said shutter swings down as urged by gravity into a closed position covering said structure opening;

said means of releasably attaching said shutter to said support comprising:

a support aperture in said support;

a support aperture cutout in said support extending from said support aperture to a support lower edge;

said actuator comprising a piston reciprocating in a cylinder, and an actuator shaft attached to said piston;

an actuator shaft head at an extreme of said actuator shaft opposite said piston, said support aperture being sized to slidably admit said actuator head; and an actuator shaft neck disposed adjacent said actuator shaft head, between said actuator shaft head and said piston, said support aperture cutout being sized to slidably admit said actuator shaft neck, a width of said support aperture exceeding a width of said support aperture cutout; whereby actuation of said actuator causes said actuator shaft to translate axially so as to move said actuator shaft head out of said support aperture and align said actuator shaft neck with said support aperture cutout, thereby permitting said actuator shaft neck to slide out of said support aperture through said support aperture cutout, and permitting said shutter to swing down as urged by gravity into a closed position covering said structure opening.

2. The automatic storm shutter of claim 1 wherein said piston separates an interior of said cylinder into a cylinder gas side disposed on a side of said piston opposite said actuator shaft, and a cylinder open side disposed on a side of said piston opposite said cylinder gas side, said cylinder gas side being closed and filled with gas, said gas within said cylinder gas side being entrapped in said cylinder on a side of said piston opposite said actuator shaft.

3. The automatic storm shutter of claim 2 wherein said cylinder open side communicates with an atmospheric pressure external to said actuator, and wherein a pressure of said gas is substantially 14.7 pounds per square inch.

4. The automatic storm shutter of claim 3 further comprising friction between said actuator shaft head and said support aperture, and internal actuator friction, a sum of said friction between said actuator shaft head and said support aperture, and said internal actuator friction, requiring substantially 2.7 pounds per square inch differential pressure between said gas pressure and atmospheric pressure to overcome.

5. The automatic storm shutter of claim 2 wherein a width of said actuator shaft head exceeds a width of said actuator shaft neck.

6. The automatic storm shutter of claim 5 wherein a width of said support aperture exceeds a width of said support aperture cutout; a width of said actuator shaft head is less than said width of said support aperture and greater than said width of said support aperture cutout; and a width of said actuator shaft neck is less than said width of said support aperture cutout.

7. The automatic storm shutter of claim 5 wherein a cross-sectional shape of said actuator shaft neck, said actuator shaft head, and said support aperture is round, a diameter of said support aperture exceeds a width of said support aperture cutout; a diameter of said actuator shaft head is less than said diameter of said support aperture and greater than said width of said support aperture cutout; and a diameter of said actuator shaft neck is less than said width of said support aperture cutout.

8. The automatic storm shutter of claim 2 wherein said shutter substantially co-extends with said structure opening when said shutter is closed.

9. The automatic storm shutter of claim 8 wherein said shutter and said structure opening are substantially rectangular.

10. The automatic storm shutter of claim 9 wherein said shutter comprises a shutter hinge edge parallel to and adjacent said hinge, a shutter distal edge opposite said shutter hinge edge, and shutter side edges between said shutter hinge edge and said shutter distal edge; and wherein said structure opening comprises a structure opening top edge parallel to and adjacent said hinge, a structure opening bottom edge, and structure opening side edges between said structure opening top edge and said structure opening bottom edge.

11. The automatic storm shutter of claim 10 wherein a length of said shutter hinge edge exceeds a length of said structure opening top edge, a length of said shutter distal edge exceeds a length of said structure opening bottom edge, and a length of said shutter side edges exceeds a length of said structure opening side edge, whereby said shutter overlaps said structure opening when said shutter is closed.

12. The automatic storm shutter of claim 2 further comprising at least one additional shutter below said shutter, each said additional shutter being attached to said shutter or one or more said additional shutters by means of one or more elongate members, whereby planes containing said shutter and said additional shutters are substantially parallel.

13. The automatic storm shutter of claim 12 wherein at least one said shutter comprises a shutter distal edge lip disposed along an edge of said shutter opposite said hinge, said shutter distal edge lip being concave in cross-section, an open end of said shutter distal edge lip facing one said hinge from which one said additional shutter depends, said shutter distal edge lip being sized to admit said hinge.

14. The automatic storm shutter of claim 2 wherein said support aperture cutout extends downwards from said support aperture, whereby gravity can effectively urge said actuator shaft neck to slide out of said support aperture and said support aperture cutout, and thus disengage said actuator and said shutter from said support.

15. An automatic storm shutter system comprising a support, and an actuator attached to a shutter;

said support comprising a support aperture and a support aperture cutout extending downwards from said support aperture to a support lower edge;

said actuator comprising a piston reciprocating in a cylinder and an actuator shaft attached to said piston;

said actuator shaft comprising an actuator shaft head at an extreme opposite said piston, and an actuator shaft neck disposed adjacent said actuator shaft head, between said actuator shaft head and said piston;

a width of said support aperture exceeding a width of said support aperture cutout; a width of said actuator shaft head being less than said width of said support aperture and greater than said width of said support aperture cutout; and a width of said actuator shaft neck being less than said width of said support aperture cutout.

16. The automatic storm shutter of claim 15 wherein said piston separates an interior of said cylinder into a cylinder gas side disposed on a side of said piston opposite said actuator shaft, and a cylinder open side disposed on a side of said piston opposite said cylinder gas side, said cylinder gas side being closed and filled with gas, whereby gas within said cylinder gas side is entrapped on a side of said piston opposite said actuator shaft.

17. The automatic storm shutter of claim 16 wherein said cylinder open side communicates with an atmospheric pressure external to said actuator, and wherein a pressure of said gas is substantially 14.7 pounds per square inch.

18. The automatic storm shutter of claim 17 further comprising friction between said actuator shaft head and said support aperture, and internal actuator friction, a sum of said friction between said actuator shaft head and said support aperture, and said internal actuator friction, requiring substantially 2.7 pounds per square inch differential pressure in said gas to overcome.

19. The automatic storm shutter of claim 18 further comprising at least one additional shutter below said shutter, and each said additional shutter is attached to said shutter or one or more said additional shutters by means of one or more elongate members.

20. The automatic storm shutter of claim 19 wherein said elongate member is sized to maintain planes containing said shutter and said additional shutters substantially parallel.

* * * * *